US006086636A

United States Patent [19]

Mheidle et al.

[11] Patent Number: 6,086,636

[45] Date of Patent: Jul. 11, 2000

[54] PRINTING OF FIBRE MATERIALS

[75] Inventors: Mickael Mheidle, Sausheim, France; Peter Scheibli, Bottmingen, Switzerland

[73] Assignee: Ciba Specialty Chemicals Corporation, Tarrytown, N.Y.

[21] Appl. No.: 09/089,147

[22] Filed: Jun. 2, 1998

[30] Foreign Application Priority Data

Jun. 17, 1997 [CH] Switzerland ..... 1472/97

[51] Int. Cl.[7] ..... D06P 1/382; D06P 1/384

[52] U.S. Cl. ..... 8/445; 8/543; 8/549; 8/585; 8/918; 8/561; 8/930

[58] Field of Search ..... 8/445, 466, 543–9, 8/930, 585

[56] References Cited

FOREIGN PATENT DOCUMENTS 3-69682 3/1991 Japan .
3-69682 1/1993 Japan .
6-287870 10/1994 Japan .
6-287871 10/1994 Japan .

OTHER PUBLICATIONS

W. B. Achwal, *Ecological Evaluation of Two Phase Reactive Printing,* Colourage, Jan. 1995, pp. 40–41

*Primary Examiner*—Margaret Einsmann
*Attorney, Agent, or Firm*—Kevin T. Mansfield

[57] ABSTRACT

Disclosed is a process for printing fibre material with reactive dyes, which comprises the fibre material to be printed first being treated with an aqueous alkaline liquor, optionally dried and then printed with a print paste comprising at least one reactive dye, a thickener and optionally further additives with the exception of an alkali or an alkali donor.

10 Claims, No Drawings

PRINTING OF FIBRE MATERIALS

This invention relates to a process for printing fibre materials, especially cellulosic fibre materials, with reactive dyes.

The printing of fibre materials with a reactive dye print paste is well-known in the textile industry. The print pastes used in this process, however, have certain disadvantages, since the presence of the necessary alkali donors frequently limits their stability in storage and means that only alkali-stable reactive dyes can be present.

A "two phase printing process" is also known. In said process, the fibre material is firstly printed with a print paste without an alkali or alkali donor, and the printed fibre material is dried and then treated with an optionally thickened aqueous alkaline liquor. However, this process does not fully meet all present-day requirements, especially with regard to the contour crispness of the prints and because of the use of large amounts of electrolyte to finish the prints.

It has now been found that, surprisingly, these disadvantages can be overcome by the process of the present invention.

The present invention accordingly provides a process for printing fibre material with reactive dyes, which comprises the fibre material to be printed first being treated with an aqueous alkaline liquor, optionally dried and then printed with a print paste comprising at least one reactive dye, a thickener and optionally further additives with the exception of an alkali or an alkali donor.

The process of the present invention is especially notable for the fact that the print pastes used therein have very good stability in storage even when the reactive dyes used are not stable to alkali and that the prints, especially stencil prints, have crisp contours. Furthermore, there is no need for electrolyte to finish the prints.

The aqueous alkaline liquor comprises at least one of the customary bases which are used for fixing the reactive dyes in the conventional reactive printing process. Examples of such bases are sodium carbonate, sodium hydroxide, disodium phosphate, trisodium phosphate, sodium acetate, sodium propionate, sodium bicarbonate, aqueous ammonia or alkali donors, for example sodium chloroacetate or sodium formate. Preference is given to using sodium bicarbonate, sodium carbonate or a mixture of waterglass and sodium carbonate. The pH of the alkaline liquor is generally 7.5 to 13.5, preferably 8.5 to 12.5.

As well as the bases, the aqueous alkaline liquor may comprise further additives, advantageously hydrotropes, for example.

The preferred hydrotrope is urea, which is used, for example, in an amount of 25 to 200 g/l of liquor, preferably 50 to 150 g/l of liquor.

The reactive dyes present in the print paste are reactive dyes customarily used for printing cellulosic fibre materials, for example as described in the Colour Index, 3rd edition 1971 and supplements thereto.

Preference is given to the use of dyes of the monoazo, disazo, polyazo, metal complex azo, anthraquinone, phthalocyanine, formazan and dioxazine series which contain at least one reactive group.

Reactive groups are fibre-reactive radicals capable of reacting with the hydroxyl groups of cellulose, amino, carboxyl, hydroxyl and thiol groups in the case of wool and silk or with the amino and possibly carboxyl groups of synthetic polyamides to form covalent chemical bonds. The reactive groups are generally attached directly or via a bridge member to the dye residue. Suitable reactive groups include for example those containing at least one detachable substituent on an aliphatic, aromatic or heterocyclic radical or in which the radicals mentioned contain a radical, for example a halotriazinyl, halopyrimidinyl or vinyl radical, suitable for reaction with the fibre material.

Preferred aliphatic reactive groups are those of the formulae —$SO_2Y$, —$SO_2$—NH—Y, —NH—CO-alk-$SO_2Y$, —CO—NH-alk-$SO_2Y$, or —NH—CO—$Y_1$, where Y is a leaving group, for example β-sulfatoethyl, β-thiosulfatoethyl, β-phosphatoethyl, β-acyloxyethyl, β-haloethyl or vinyl, $Y_1$is for example an a,b-dihaloethyl or a-haloethenyl radical, alk is $C_1$–$C_6$alkylene and halogen is preferably chlorine or bromine.

Preferred heterocyclic fibre-reactive radicals are 1,3,5-triazine radicals of the formula (1)

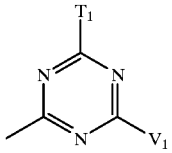

where $T_1$ is fluorine, chlorine or carboxypyridinium and the substituent $V_1$ on the triazine ring is in particular fluorine or chlorine; —$NH_2$, substituted or unsubstituted alkylamino or N,N-dialkylamino groups, for example unsubstituted or hydroxyl-, sulfo- or sulfato-substituted N-mono- or N,N-di-$C_1$–$C_4$alkylamino; cycloalkylamino; aralkylamino, e.g., benzylamino; arylamino groups such as unsubstituted or sulfo-, methyl-, methoxy- or chlorine-substituted phenylamino; mixed substituted amino groups, such as N-alkyl-N-cyclohexylamino or N-alkyl-N-phenylamino groups; morpholino; and also fibre-reactive radicals of the formula (2)

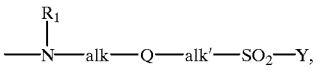

(3)

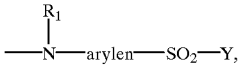

(4)

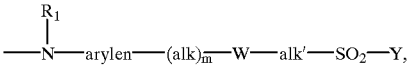

-continued (5)

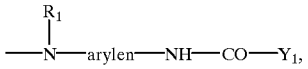

(6)

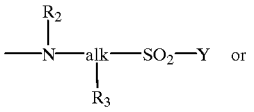

(7)

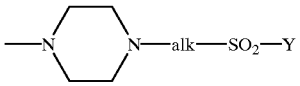

where $R_1$ is hydrogen or $C_1$–$C_4$alkyl, $R_2$ is hydrogen, unsubstituted or hydroxyl-, sulfo-, sulfato-, carboxyl-, halogen- or cyano-substituted $C_1$–$C_4$alkyl or a radical, $R_3$ is hydrogen, hydroxyl, sulfo, sulfato, carboxyl, cyano, halogen or an —$SO_2$—Y group, alk and alk' are independently $C_1$–$C_6$-alkylene, arylen is an unsubstituted or sulfo-, carboxyl-, $C_1$–$C_4$alkyl-, $C_1$–$C_4$alkoxy- or halogen-substituted phenylene or naphthylene radical, Q is —O— or —$NR_1$—, where $R_1$ is as defined above, W is —$SO_2$—$NR_2$—, —$CONR_2$— or —$NR_2CO$—, where $R_2$ is in each case as defined above, m is 0 or 1, and Y and $Y_1$ are each as defined above.

Particularly preferred reactive groups are vinylsulfonyl, chlorotriazine and fluorotriazine.

Very particularly preferred reactive groups are vinylsulfonyl and fluorotriazine.

It is also possible to use dyes having two or more identical or different reactive groups.

The amount of reactive dye in the print paste can vary within wide limits depending on the desired depth of shade and is for example 2 to 100 g/kg of print paste, preferably 10 to 70 g/kg of print paste, especially 10 to 50 g/kg of print paste.

Preference is given to the use of reactive dyes of medium affinity for the fibre. Particular preference is given to the use of reactive dyes having high affinity for the fibre.

The print pastes used according to the invention may comprise one or more reactive dyes.

The thickener in the print paste can be the customary reactive printing thickeners of natural or synthetic origin, for example commercially available alginate thickeners, starch ethers or carob bean flour ethers, cellulose derivatives, for example cellulose ethers, such as methyl-, ethyl-, hydroxyethyl-, methylhydroxyethyl-, hydroxypropyl-, hydroxypropylmethyl-, carboxymethyl-, carboxyethyl- or cyanoethyl-cellulose, or a cellulose ester such as, for example, acetylcellulose.

Preference is given to using print pastes comprising sodium alginate alone or mixed with modified cellulose, especially with preferably 20 to 25 per cent by weight of carboxymethyl-cellulose, as thickener.

The amount of thickener in the print paste can vary within wide limits depending on the desired viscosity; the thickener is preferably present in the print paste in amounts of 5 to 100 g/kg of print paste, especially 10 to 80 g/kg of print paste, in particular 10 to 60 g/kg of print paste.

Print paste viscosity is generally between 1000 and 20,000 mPa.s. Preference is given to print pastes having a viscosity between 2500 and 15,000 mPa.s, especially between 4000 and 6000 mPa.s.

As well as the reactive dyes and thickeners, the print paste may further comprise customary auxiliaries, for example preservatives, sequestrants, emulsifiers, water-insoluble solvents, oxidants, reduction inhibitors or deaerators.

Suitable preservatives are in particular formaldehyde-suppliers, for example paraformal-dehyde and trioxane, especially aqueous, about 30 to 40 per cent strength by weight formaldehyde solutions; suitable sequestrants include for example sodium nitrilotriacetate, sodium ethylenediaminetetraacetate, especially sodium polymetaphosphate, in particular sodium hexametaphosphate; suitable emulsifiers are in particular adducts of an alkylene oxide and fatty alcohol, in particular an adduct of oleyl alcohol and ethylene oxide; suitable water-insoluble solvents are high boiling saturated hydrocarbons, especially paraffins having a boiling range from about 160 to 210° C. (varnish maker's naphtha); and suitable oxidants, include for example an aromatic nitrocompound, especially an aromatic mono- or dinitrocarboxylic acid or -sulfonic acid, which is optionally present as an alkylene oxide adduct, especially a nitrobenzenesulfonic acid.

Suitable reduction inhibitors include for example aromatic nitrocompounds, especially salts of aromatic mono- or dinitrocarboxylic acids or -sulfonic acids, which are optionally present as alkylene oxides, especially alkali metal salts of a nitrobenzenesulfonic acid, e.g. sodium 2-nitrobenzoate. The reduction inhibitors are preferably used in an amount of 0.1 to 4% by weight, especially 0.8 to 2% by weight, based on the total weight of the finished print paste.

Any commercially available deaerators can be used, provided the rheological properties of the print paste are not adversely affected. Owing to their good defoaming properties, preference is given to deaerators which are low in or free from silicone fluid, generally comprising from 0 to 5% by weight of a conventional silicone fluid. Of particular interest are deaerators where the active ingredient is a higher alcohol, for example 2-ethyl-n-hexanol or 2-hexyldecanol or a mixture thereof with high boiling hydrocarbon mixtures, and which have the above-indicated silicone fluid content.

In the print paste the deaerator is present, for example, in an amount of 0 to 5% by weight, preferably of 0.1 to 1% by weight, based on the total weight of the finished print paste.

To print the fibre materials, the print paste is applied uniformly or areawise directly to the fibre material, advantageously using printing machines of customary design, for example intaglio, rotary screen printing and flat screen printing machines. The process of the present invention is particularly advantageous for use with stencil printing.

Cellulosic fibre materials are preferred.

Cellulosic fibre materials are materials which consist of or comprise cellulose. Examples are natural fibre materials such as cotton, linen or hemp, regenerated fibre materials such as, for example, viscose, polynosic or cupro, or cellulosic fibre blend materials such as, for example, cotton/polyester materials. These fibres are mainly used in the form of wovens, knits or nonwovens.

After printing, the fibre material is advantageously dried, preferably at temperatures up to 150 C., especially 80 to 120 C., and then subjected to a heat treatment process to complete the print or, to be precise, to fix the dye.

The heat treatment can be carried out as a hot batch process, a thermosoling process or preferably as a steaming process (HT fixation).

In the steaming process, the printed fibre material is subjected to a treatment in a steamer with optionally superheated steam, advantageously at a temperature of 95 to 210° C., advantageously 100 to 180° C.

The printed fibre material is preferably HT-fixed by treating at 150 to 170° C. for 2 to 5 minutes.

The finishing of the prints by the thermosoling process can be effected with or without intermediary drying, for example at a temperature of 100 to 210° C. The thermosoling is preferably effected at a temperature of 120 to 210° C., especially 140 to 180° C. Depending on the temperature, the thermosoling can take 20 seconds to 5 minutes, preferably 30 seconds to 4 minutes.

The thermosoling is customarily carried out at 190 to 210° C. for 1 to 2 minutes.

Following the printing process, the printed fibre material is conventionally washed off to remove unfixed dye. For this purpose, the fibre material is for example treated at 40° C. to the boil with water which may optionally include a soap or a synthetic detergent.

In a preferred embodiment of the process of the present invention, a cellulosic fibre material to be printed, especially cotton, is pad-mangled at a pH of from 7.5 to 13.5, preferably 8.5 to 12.5, with a liquor comprising per 1 l of liquor 10 to 100, preferably 30 to 50, g of a base, preferably sodium bicarbonate, and 0 to 200 g of urea and the fibre material is dried at 80 to 120° C.

The pretreated fibre material is then printed with a print paste comprising per kg of print paste 10 to 30 g of a reactive dye and 400 to 600 g of a commercially available alginate thickener and dried at 100° C. Thereafter the print is fixed with saturated steam at 102° C. for 4 minutes, rinsed cold, washed off at the boil and again rinsed cold.

The prints on cellulosic fibre materials obtainable by the process of the present invention have good all-round fastness properties; they have, for example, a high fibre-dye bond stability not only in the acid but also in the alkali range, good lightfastness, good wetfastnesses, such as good wash, water, seawater, crossdyeing and perspiration fastnesses, good chlorine fastness, rubfastness and fastness to pleating and dry heat setting, and are especially notable for crisp contours and high color strength.

The examples which follow serve to illustrate the invention. Temperatures are reported in degrees Celsius, parts and percentages are by weight, unless otherwise stated. Parts by weight relate to parts by volume as the kilogram relates to the litre.

EXAMPLE 1

Mercerized cotton satin fabric is padded with a liquor comprising 30 g/l of sodium bicarbonate, mangled to a wet pick-up of 70% and then dried.

The pretreated cotton satin fabric is then printed with a print paste comprising per kg of print paste 20 g of the dye of the formula (100)

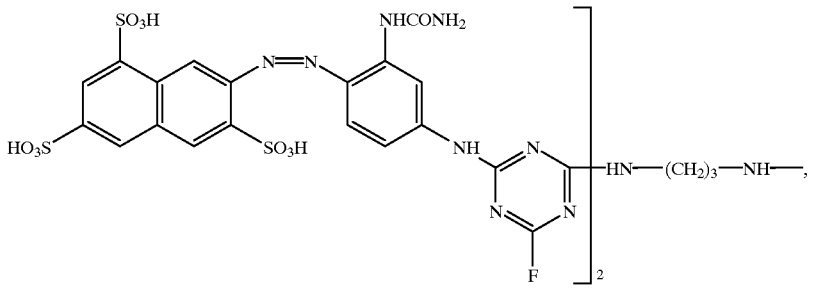

and 500 g of a commercially available alginate thickener (®Lamitex M5 6%). The print is dried at 120° C. for 90 seconds and then fixed with saturated steam at 102° C. for 4 minutes. After fixing, the print is rinsed with cold water, washed off in boiling water, rinsed again with cold water and dried.

A yellow print having good washfastnesses is obtained.

EXAMPLES 2–10

Example 1 is repeated with the 20 g of the dye of the formula (100) being replaced with the same amounts of the dyes of the formulae (101)
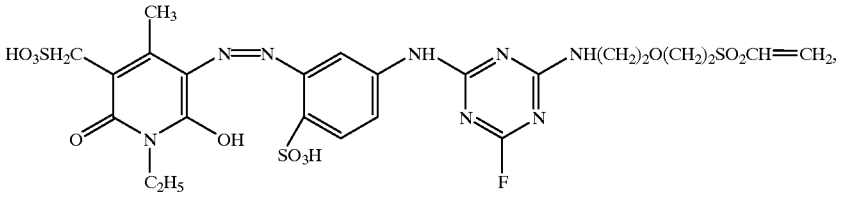
(102)
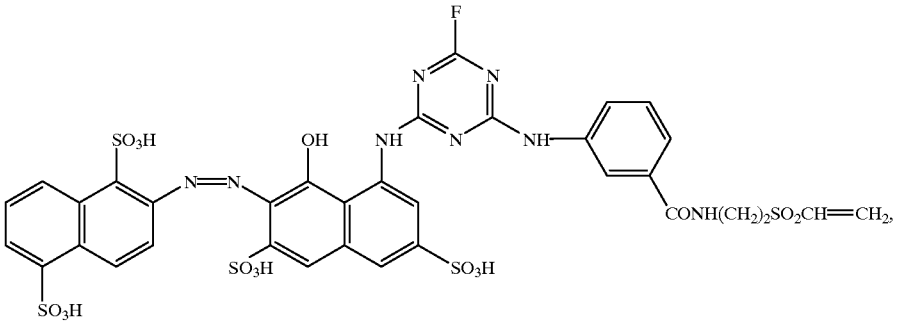
(103)
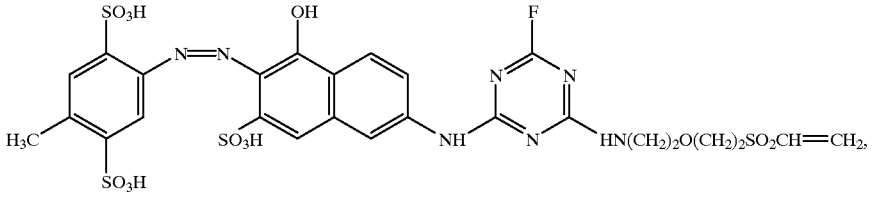
(104)
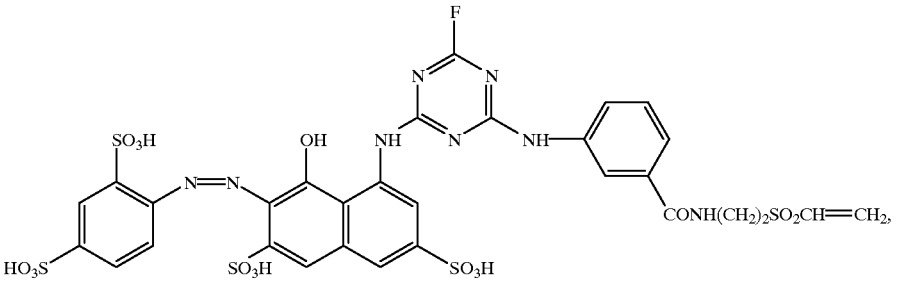
(105)
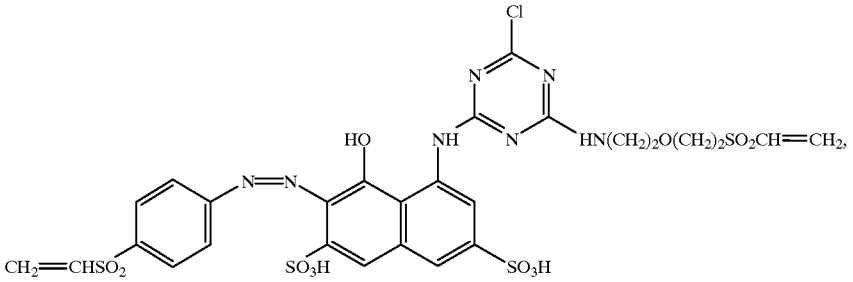

-continued
(106)
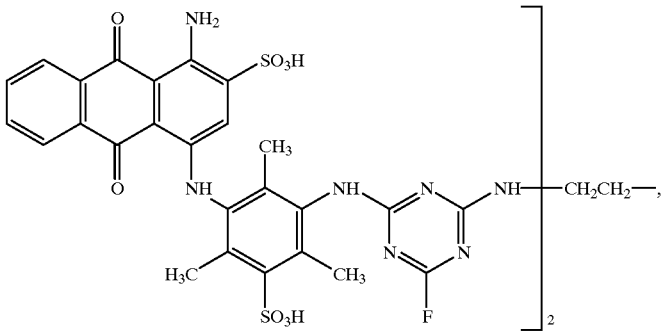
(107)
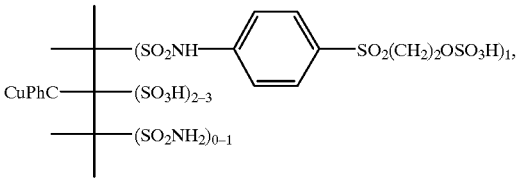
(108)
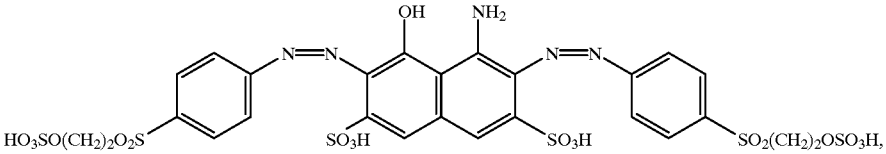
or
(109)
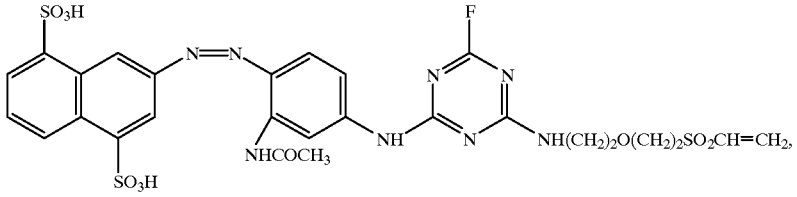
or the same amount of a dye mixture (110) comprising
80% by weight of the dye of the formula
(110a)
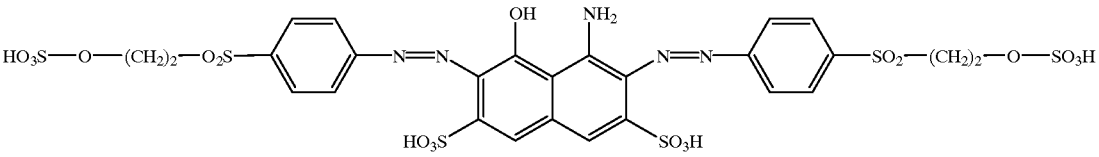
and
20% by weight of the dye of the formula (110b)

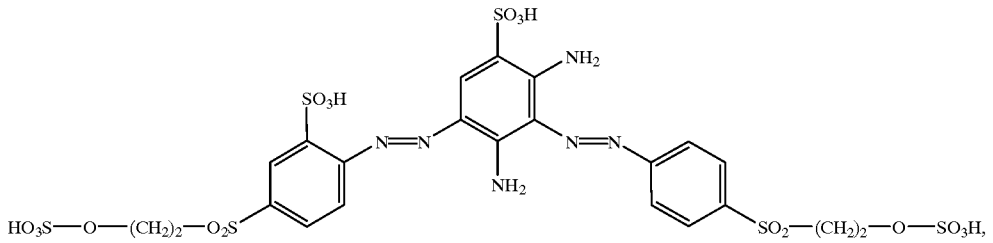

likewise affording prints having good washfastnesses.

EXAMPLE 11

Mercerized cotton satin fabric is padded with a liquor comprising 30 g/l of sodium bicarbonate, and 50 g/l of urea, mangled to a wet pick-up of 70% and then dried.

The pretreated cotton satin fabric is then printed with a print paste comprising per kg of print paste 20 g of the dye of the formula (100), and 500 g of a commercially available alginate thickener (®Lamitex M5 6%). The print is dried at 120° C. for 90 seconds and then fixed with saturated steam at 102° C. for 4 minutes. After fixing, the print is rinsed with cold water, washed off in boiling water, rinsed again with cold water and dried.

A yellow print having good washfastnesses is obtained.

EXAMPLES 12–20

Example 11 is repeated with the 20 g of the dye of the formula (100) being replaced with the same amount of one of the dyes of the formulae (101) to (109) or of the dye mixture (110), likewise affording prints having good washfastnesses.

EXAMPLE 21

Causticized viscose fabric is padded with a liquor comprising 30 g/l of sodium bicarbonate, and 100 g/l of urea mangled to a wet pick-up of 70% and then dried.

The pretreated viscose fabric is then printed with a print paste comprising per kg of print paste 20 g of the dye of the formula (100), and 500 g of a commercially available alginate thickener (®Lamitex M5 6%). The print is dried at 120° C. for 90 seconds and then fixed with saturated steam at 102° C. for 4 minutes. After fixing, the rint is rinsed with cold water, washed off in boiling water, rinsed again with cold water and dried.

A yellow print having good washfastnesses is obtained.

EXAMPLES 22–30

Example 21 is repeated with the 20 g of the dye of the formula (100) being replaced with the same amount of one of the dyes of the formulae (101) to (109) or of the dye mixture (110), likewise affording prints having good washfastnesses.

EXAMPLE 31

Causticized viscose fabric is padded with a liquor comprising 30 g/l of sodium bicarbonate, and 150 g/l of urea mangled to a wet pick-up of 70% and then dried.

The pretreated viscose fabric is then printed with a print paste comprising per kg of print paste 20 g of the dye of the formula (100), 500 g of a commercially available alginate thickener (®Lamitex M5 6%). The print is dried at 120° C. for 90 seconds and then fixed with saturated steam at 102° C. for 4 minutes. After fixing, the print is rinsed with cold water, washed off in boiling water, rinsed again with cold water and dried.

A yellow print having good washfastnesses is obtained.

EXAMPLES 32–40

Example 31 is repeated with the 20 g of the dye of the formula (100) being replaced with the same amount of one of the dyes of the formulae (101) to (109) or of the dye mixture (110), likewise affording prints having good washfastnesses.

What is claimed is:

1. A process for printing fibre material with reactive dyes, which comprises the fibre material to be printed first being padded with an aqueous alkaline liquor, optionally dried and then printed with a print paste comprising at least one reactive dye, a thickener and optionally further additives with the exception of an alkali or an alkali donor using an intaglio, rotary screen printing or flat screen printing machine or stencil printing thereby obtaining a print on said fiber material having crisp contours.

2. A process according to claim 1, wherein the aqueous alkaline liquor comprises at least one base selected from the group consisting of sodium carbonate, sodium hydroxide, disodium phosphate, trisodium phosphate, sodium acetate, sodium propionate, sodium bicarbonate, aqueous ammonia, sodium chloroacetate and sodium formate.

3. A process according to claim 2, wherein the aqueous alkaline liquor comprises sodium bicarbonate, sodium carbonate or a mixture of waterglass and sodium carbonate.

4. A process according to claim 1, wherein the aqueous alkaline liquor comprises urea.

5. A process according to claim 1, wherein reactive dyes of medium affinity for the fibre are used.

6. A process according to claim 1, wherein reactive dyes having a vinylsulfonyl, chlorotriazine or fluorotriazine reactive group are used.

7. A process according to claim 1, wherein the thickener used is an alginate thickener.

8. A process according to claim 1, wherein the print paste used has a viscosity between 1000 and 20,000 mPa.s.

9. A process according to claim 1, wherein the fiber material used is cellulosic fibre material.

10. A process according to claim 1, wherein the fiber material is printed by means of a stencil printing technique.

* * * * *